United States Patent [19]

Kerbart

[11] Patent Number: 4,843,875

[45] Date of Patent: Jul. 4, 1989

[54] PROCEDURE FOR MEASURING THE RATE OF PENETRATION OF A DRILL BIT

[75] Inventor: Yves Kerbart, Fontenay aux Roses, France

[73] Assignee: Schlumberger Technology Corporation, Houston, Tex.

[21] Appl. No.: 186,509

[22] Filed: Apr. 26, 1988

[30] Foreign Application Priority Data

Apr. 27, 1987 [FR] France ..... 87 05900

[51] Int. Cl.[4] ..... E21B 45/00

[52] U.S. Cl. ..... 73/151.5; 175/40

[58] Field of Search ..... 73/151, 151.5; 175/27, 175/40

[56] References Cited

U.S. PATENT DOCUMENTS

| | | | |
|---|---|---|---|
| 2,669,871 | 2/1954 | Lubinski | 73/151.5 |
| 3,777,560 | 12/1973 | Guignard | 73/151.5 |
| 4,512,186 | 4/1985 | Edwards | 73/151.5 |
| 4,616,321 | 10/1986 | Chan | 73/151.5 |

FOREIGN PATENT DOCUMENTS

| | | |
|---|---|---|
| 2038700 | 3/1969 | France . |
| 2217522 | 10/1972 | France . |

*Primary Examiner*—Stewart J. Levy
*Assistant Examiner*—Kevin D. O'Shea
*Attorney, Agent, or Firm*—Stephen L. Borst

[57] ABSTRACT

The invention relates to a procedure for measuring the rate of penetration $V_F$ of a drill bit fixed to the lower end of a drill string lowered into a well. During an initial period, the well is drilled keeping, on average, the value of weight F of the drill string measured at the surface relatively constant, and the instantaneous values of the drill string rate of penetration $V_S$ and the weight F are measured at the surface at different successive moments. The value of the drill string average rate of penetration $V_{SM}$ at the surface is determined from the values of $V_S$ measured and the successive values of dF/dt of the first derivative with respect to time. The coefficient of apparent rigidity of the drill string during the initial period is then determined from the values of $V_{SM}$, $V_S$ and dF/dt. Finally, the rate $V_F$ is calculated.

8 Claims, 2 Drawing Sheets

PROCEDURE FOR MEASURING THE RATE OF PENETRATION OF A DRILL BIT

The invention relates to a procedure for measuring the rate of penetration of a drilling bit at the working face during a rotary type well drilling operation. The drilling tool, which may be a bit, is fixed to the end of a drill string which is supported at the surface by means of a hook on the drilling rig. The drill string is subjected to a rotary movement, which allows the bit to drill. The rate of penetration of the bit in the well is simply determined by the rate of descent of the drill string at the surface. The rate of descent is therefore determined at the surface. However, the drill string which is formed by steel pipes is relatively elastic, and deforms along its length under the effect of the traction and compression to which it is subjected. This leads to variations in length which seriously affect the measurements of the rate of penetration of the bit at the bottom of the well. The errors are greater as the drilling depth increases and thus the drill string gets longer, so that the forces acting on the drill string are greater and the friction between the drill string and the well walls is greater. In the latter case, which is relatively frequent when the well is not drilled vertically, the weight applied to the drill string at the surface is not transmitted in full to the drill bit.

To overcome these problems, it is proposed in U.S. Pat. No. 2,688,871 to consider the drill string as a spring with a certain elasticity. The modulus of elasticity is determined theoretically from the known length and section of the drill string and the Young's modulus of the steel. This value of the modulus of elasticity is recalculated from time to time to take account of the adding or removal of pipes. Taking as a model a spring of which the modulus of elasticity has been determined, it is thus possible to calculate the rate of penetration of the bit fixed to the lower end of the drill string as a function of the rate of penetration of the upper end of the drill string and the value (positive or negative) of the variation in the force applied to this upper end of the drill string.

A similar method is proposed in U.S. Pat. No. 3,777,560. The methods described in the two above-mentioned patents have the major drawback that the modulus of elasticity calculated theoretically is far from being an accurate reflection of the conditions to which the drill string is subjected in the well. It takes no account whatever of the friction between the drill string and the well walls.

A method intended to overcome the shortcomings of the previously known methods is proposed in French Pat. No. 2.038.700. In this patent it is proposed to determine the rate of penetration of the drill bit using a modulus of elasticity of the drill string measured in situ in the well. To do this, the variations in the tension to which the drill string is subjected at any of its points are determined as the bit goes down into the well . In the example mentioned, the point chosen is close to the drill bit. The measurement is made at the bottom, and the values measured are passed to the surface by electric cable. The bit is allowed to rest on the bottom without drilling, recording the moment when it makes contact with the bottom, this moment corresponding to the start of the period of decrease in the tension measured. During this period the variation in this tension and the value of the rate of descent of the drill string at the surface are determined. From these values is deduced the actual value of the modulus of elasticity.

This method is difficult to apply in practice, and is not in fact in use today. It is indeed very difficult to determine precisely the moment at which the drill bit touches the well bottom when measuring at the surface only. This is probably why the example of the embodiment proposed in this French patent relies on measurements made at the bottom of the well by means of strain gauges positioned on the drill string near the bit. A telemetry system is then necessary in order to transmit the measurements from the bottom to the surface, a major obstacle. Moreover, the modulus of elasticity is determined while drilling is not taking place. The drill string is therefore not rotating. It is now generally acknowledged that, save in exceptional cases, the frictional forces due to the longitudinal movement of the drill string in the well while the string is rotating are negligible in comparison to the frictional forces due to the rotation of the drill string in the well. The modulus of elasticity measured in situ according to the method described in this French patent is therefore not representative of the modulus of apparent elasticity corresponding to the actual conditions of drilling.

The invention discussed here offers a procedure by means of which the rate of penetration of a drill bit can be accurately measured. This procedure does not have the drawbacks mentioned above of previously known procedures.

More precisely, the invention relates to a procedure for measuring the rate of penetration $V_F$ of a drill bit fixed to the lower end of a drill string in a well being drilled, according to which the rigidity of the drill string is taken into account; this procedure comprises the following steps:

(a) during an initial time period $\Delta t$, drilling takes place keeping, on average, the value of the weight F of the drill string measured at the surface relatively constant and the momentary values of the rate of penetration $V_S$ of the drill string and the weight F of the drill string measured at the surface are measured at the surface at different successive moments, (b) the value of the average rate of penetration $V_{SM}$ of the drill string at the surface is determined from the values of $V_S$ measured and the successive values of dF/dt of the first derivative with respect to time of the measured values of the weight F, (c) the modulus of apparent rigidity $\lambda$ of the drill string is determined during time period $\Delta t$ from the values of $V_{SM}$, $V_S$ and dF/dt, (d) while drilling continues, the values of $V_S$ and F are measured at successive moments, the values of the derivative dF/dt are determined and, for each of these successive moments, the value of the rate of penetration $V_F$ of the drill bit is determined from the values of $V_S$ and dF/dt and the value of $\lambda$ determined in step (c), and (e) the preceding steps (a) to (d) are repeated regularly during the course of drilling.

Other characteristics and advantages of the invention will become apparent from the description that follows, with reference to the attached drawings, of a non-limitative example of embodiment of the procedure.

Figure 1:
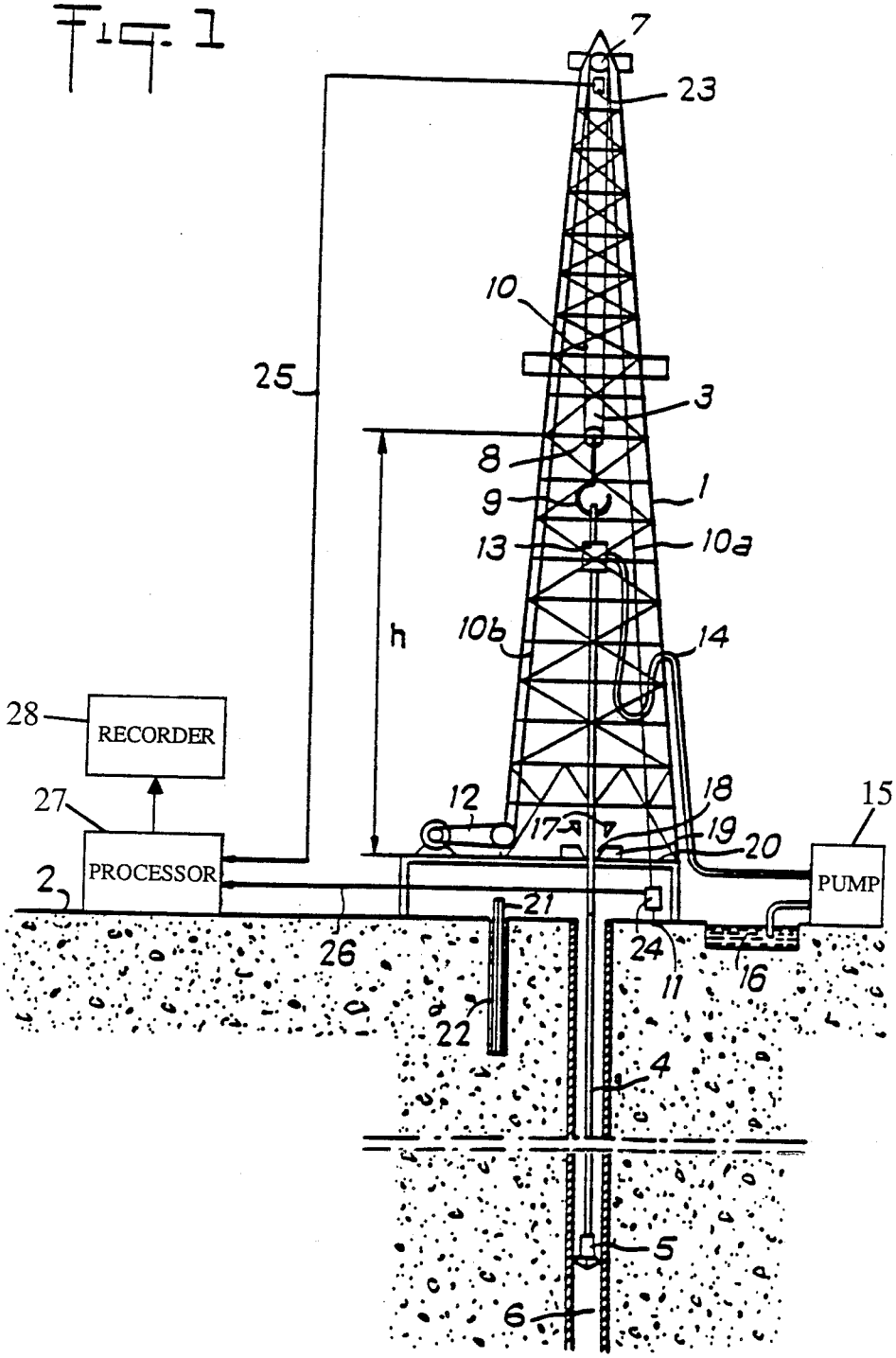
FIG. 1 represents a rotary drilling rig and the well beneath it in diagram form in vertical section.

The rotary drilling rig shown in FIG. 1 comprises a mast 1 rising above the ground 2 and fitted with lifting gear 3 from which is suspended a drill string 4 formed of drill pipes screwed one to another and having at its lower end a bit 5 for the purpose of drilling a well 6. The lifting gear 3 consists of a crown block 7, the axis of which is fixed to the top of the mast 1, a vertically travelling block 8, to which is attached a hook 9, a cable 10 passing round blocks 7 and 8 and forming, from crown block 7, on one hand a dead line 10*a* anchored to a fixed point 11 and on the other an active line 10*b* which winds round the drum of a winch 12.

The drill string 4 is suspended from hook 9 by means of a swivel 13 linked by a hose 14 to a mud pump 15, which permits injection into the well 6, via the hollow pipes of the string 4, of drilling mud from a mud pit 16, which pit may, inversely, be fed with surplus mud from the well 6. By this means, by turning the lifting gear 3 by means of winch 12, the drill string 4 may be brought up, the pipes being successively removed from the well 6 and unscrewed in order to remove the bit 5, or the drill string 4 may be lowered, successively screwing back its component pipes, in order to take the bit back down to the bottom of the well. These drill pipe raising and lowering operations require the drill string 4 to be temporarily unhooked from the lifting gear 3; the former is then supported by blocking it with wedges 17 in a conical recess 18 in the rotating table 19 mounted on a platform 20 through which the drill string passes.

During drilling periods, the drill string 4 is driven in a rotary motion by means of a kelly 21 fitted to its upper end. Between such periods the kelly is stored in a pipe sleeve 22 in the ground.

The variations in the height h of travelling block 8 during these drill string 4 raising operations are measured by means of a sensor 23. In this example, this is an angle of rotation sensor coupled to the faster pulley of crown block 7 (the pulley from which active line 10*b* leaves). This sensor gives at each moment the magnitude and direction of rotation of that pulley, from which the value and direction of linear travel of cable 10 may easily be worked out then, taking into account the number of lines between blocks 7 and 8, the value and direction of travel of block 8 and, subsequently, its height h. The measurement of the value of h as a function of time makes it possible immediately to determine the instantaneous rate of the hook 9 which is equal to the instantaneous rate $V_S$ of the drill string at the surface.

The weight F applied to hook 9 of the travelling block 8 is also measured; this corresponds to the weight of the drill string 4 in the drilling mud in the well minus the weight applied to the bit. This weight varies with the number of pipes in the string. This measurement is made by means of a strain gauge 24 inserted into dead line 10*a* of cable 10 to measure its tension. By multiplying the value given by this gauge by the number of lines between blocks 7 and 8, the weight on hook 9 is obtained.

Sensors 23 and 24 are connected by lines 25 and 26 to a processing unit 27 which processes the measurement signals and which incorporates a clock. A recorder 28 is connected to the processing unit 27, which is preferably a computer.

The parameters measured necessary for the implementation of the invention are the weight F suspended from the hook 9, the height h of the travelling block supporting this hook and the corresponding time as supplied by the clock incorporated into the computer 27. The parameters are regularly recorded at a frequency of 5 Hz and immediately digitized, i.e. converted into binary values directly usable by the computer. The recordings of these values are indexed in time. From these values the computer produces the corresponding values of the momentary rate $V_S$ of the drill string at the surface and the first derivative dF/dt of the weight F suspended from hook 9, as well as the values of $V_F$ and λ determined in the way described hereafter .

FIG. 2*a* represents a recording in function of time t, (in seconds) of the weight F (in kN) applied to the hook on the drilling rig. Generally the driller tries to keep the value of F relatively constant for a given formation. This value is selected optimally to obtain the best rate of drill bit penetration depending on the lithological conditions. The weight F on the hook is equal to the total weight of the drill string in the drilling mud in the well minus the weight effectively applied to the drill bit. The driller operates in successive sequences of a few seconds. After applying a certain weight to the bit, he blocks the drill string at the surface to prevent any longitudinal movement yet allowing the drill string to rotate in order to drill. The bit penetration into the formation then takes place by natural extension of the drill string due to its elasticity. In this case a gradual increase dF of the weight F applied to the hook is noted, and to this corresponds a decrease in the weight applied to the bit. The depth drilled during this sequence corresponds to the extension of the drill string. This extension is linked to the decrease in the weight effectively applied to the bit. Considering the drill string as a spring, the extension of the drill string, or the depth drilled, which amounts to the same thing, is equal to the product of λ dF, λ being the rigidity of the spring formed by the drill string or the inverse of its elasticity. At the end of this drilling sequence, which lasts only a few seconds, the value of the weight F is too divergent from the set value, and the driller then decides to release the longitudinal movement of the drill string. In other words, he adds weight to the drill bit, which is equivalent to reducing the value of the weight F applied to the hook by the same amount. During this second sequence, the depth of well drilled is equal to the variation in the length of the drill string measured at the surface plus the variation in the length of the drill string. The variation in length is in fact equal to the product of λ by the variation of the weight F at the hook. Consequently, the following expression may be written:

$$V_F = V_S + \lambda \frac{dF}{dt} \qquad \text{(I)}$$

where $V_F$ and $V_S$ represent the instantaneous rates of the drill bit and the drill string at the surface respectively, λ represents the apparent rigidity of the drill string in the well at the moment of measurement and under the drilling conditions, and dF/dt represents the first derivative with respect to time t of the weight F suspended from the hook.

FIG. 2*b* shows the values of the momentary rate $V_S$ of the drill string at the surface, expressed in metres per hour, determined as stated previously using measurements of the variations in the height h of the hook as a function of time.

FIG. 2c represents the values of the momentary rate $V_F$ of the drill bit expressed in metres per hour. According to the preferred embodiment of this invention, the starting point is to consider the rate of penetration of the drill bit to be equal to the average rate of descent of the drill string at the surface $V_{SM}$. Thus, $V_{SM}$ is first of all determined during a period of time $\Delta t$ of nil to approximately 350 seconds in the example shown in FIG. 2c. This time period may be shortened to for instance 100 seconds. It will be seen that rates $V_S$ and $V_F$ are equal on FIGS. 2b and 2c over the time period involved. The modulus of apparent rigidity $\lambda$ of the drill string in the well is then determined for these drilling conditions. To do this, knowing that for this first time period considered, $V_F = V_{SM}$, the following equation may be written:

$$V_{SM} - V_S = \lambda \frac{dF}{dt} \quad (1)$$

Knowing $V_{SM}$, a corresponding value for the drill string rigidity $\lambda$ is then determined for each value of $V_S$ and dF/dt. However, over a period of time as short as that used here, the modulus $\lambda$ may be regarded as constant. A mean value is then determined from the measurements made, noting that the preceding expression is the equation of a straight line of slope $\lambda$. One approach is to apply the least error squares method. In the following step, drilling continues and the values of $V_S$ and dF/dt continue to be taken sequentially. The modulus of rigidity $\lambda$ being known, the rate of penetration $V_F$ of the drill bit is determined using equation 1. These successive values are represented on FIG. 2c after the time period of 0 to 350 seconds.

It will be seen that for each pair of values of $V_S$ and F newly acquired, a new value of $\lambda$ and $V_F$ may be recalculated. This makes it possible to monitor, during drilling, the changing apparent rigidity $\lambda$ of the drill string and the momentary rate $V_S$ of the drill string. Where the computing capacity available at the drilling site (computer 28–FIG. 1) is not sufficient, the new value of $\lambda$ may be calculated only after drilling through a certain depth of formation, for example every meter.

It may be seen that although it was considered at the outset that drilling was carried out with a relatively constant weight on the bit, it is necessary in order to determine the value of 80 with sufficient accuracy to have sufficiently large variations in the weight F. In other words, to determine $\lambda$ the spring formed by the drill string must tighten and relax with sufficient amplitude.

On FIG. 2d the successive values of the modulus of rigidity $\lambda$ calculated every 350 seconds have been represented. The variations in this modulus are of significance in practical terms. This modulus in fact represents not only the theoretical rigidity of the drill string, out of the well, but also the friction or jamming of the drill string in the well. It is thus possible to determine which areas of the well are liable to cause problems when raising or lowering the drill string.

It is generally recognized that for a given lithology the rate of penetration of the drill bit is more or less proportional to the weight applied to the bit. In order to obtain information that is independent of variations in weight on the bit, a normalised instantaneous rate $V_{SN}$ may be determined, equal to the instantaneous rate $V_S$ of penetration of the bit divided by the weight applied to the bit at the instant in question. One of the important practical applications of this normalised rate is the determining on the instant when drilling of the formation recommences after relowering the drill string into the well. The usual approach is to consider that drilling recommences for example if the weight on the bit is over one tonne. This approach is arbitrary and is the source of errors. By means of the present invention it may be considered that drilling of the formation recommences when the normalised instantaneous rate of penetration $V_{SN}$ of the drill bit is similar to the normalised rate obtained before adding the new pipe (continuity of the lithology). This condition in relation to the normalised rate may of course be linked to other conditions such as the hook height (after estimating the hook height at the time of recommencement of drilling from the position of the hook at the end of drilling with the previous pipe and an automatic estimate of the length of the new pipe when connected) or a threshold for the value of the weight on the bit.

It may also be noted that a variation in this normalised rate $V_{SN}$ may express a change in the lithology.

Figure 2:
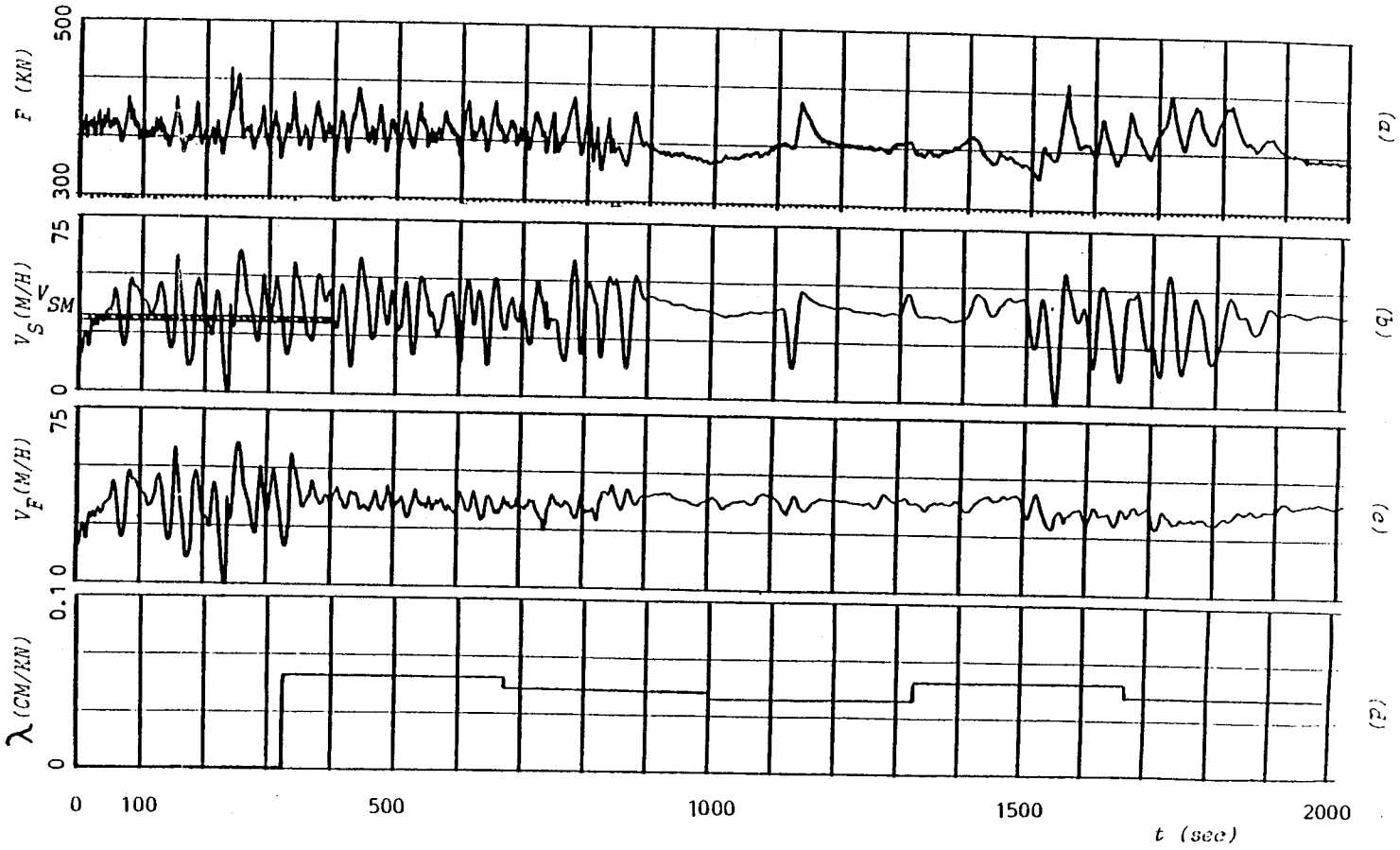
FIG. 2 shows part of a recording of the values measured, as a function of time, of the momentary rate of penetration $V_S$ of the drill string measured at the surface, the weight F measured at the hook on the drilling rig supporting the drill string, the values of the momentary rate $V_F$ of the drill bit and the modulus of apparent rigidity determined according to this invention.

It should be noted that the diagrams in FIG. 2 are given in function of time t. These diagrams may of course be converted in order to present them as a function of the depth drilled.

I claim:

1. A procedure for measuring the rate of penetration $V_F$ of a drill bit fixed to the lower end of a drill string in a well being drilled, according to which the rigidity of the drill string is taken into account, characterized by the following steps:

a. during an initial time period, carrying out the drilling process while maintaining, on average, a constant value of the weight F of the drill string measured at the surface;

b. during said initial time period, measuring a plurality of values of the position, of the drill string at the surface;

c. during said initial time period, measuring a plurality of values of the weight of the drill string at the surface;

d. in response to the measured values of drill string position an drill string weight, determining the modulous of apparent rigidity of the drill string during said initial period, e. in response to the value of the modulus of apparent rigidity, determining the value of the rate of penetration $V_F$ of the drill bit while drilling subsequent to said initial time period.

2. The procedure according to claim 1 including the steps of determining a plurality of values, of the rate of penetration $V_S$ of the drill string at the earth's surface in response to said plurality of values of drill string position, determining the average rate of penetration $V_{SM}$ of the drill string over said initial time period in response to said values of $V_S$, determining a plurality of first derivatives with respect to time of the weight F (dF/dt) in response to said plurality of measurements of F, and, in response to said values of $V_{SM}$, dF/dt, and $V_S$, determining said plurality of values of the modulus of apparent rigidity.

3. A procedure according to claim 2, wherein $V_F$ is determined from the following equation:

$$V_F = V_S + \lambda \frac{dF}{dt}.$$

4. A procedure according to claim 2 in which the value of the modulus of apparent rigidity λ is determined from the following equation:

$$V_{SM} - V_S = \lambda \frac{dF}{dt}$$

in which the average rate of penetration $V_{SM}$ over the initial time period has been substituted for the instantaneous rate of penetration $V_F$ and in which.

5. A procedure according to claim 4 in which the average value of the apparent modulus of rigidity is determined by drawing the graph representing ($V_{SM}-V_S$) as the ordinate and dF/dt as the abscissa and then applying a least squares method to determine the value of the slope λ of the straight line best representing the following equation:

$$V_F - V_S = \lambda \frac{dF}{dt}$$

6. A procedure according to claim 1 in which successive values of the apparent modulus of rigidity are recorded as a function of time or the depth drilled so as to give a curve characteristic of the drilling conditions.

7. The procedure according to claim 3 in which successive values of the normalized instantaneous rate of penetration $V_{SN}$ are determined by computing, for each instant of measurement, the ratio of $V_S$ divided by the weight on the bit, and in which the curve $V_{SN}$ is recorded as a function of time or of the depth drilled to give an indication with regard to the lithology of the formation drilled.

8. The procedure according to claim 7 in which the normalized value of rate of penetration ($V_{SN}$) is used to determine when drilling of the formation recommences after a drilling interruption.

* * * * *